US011139107B2

(12) United States Patent
Yoshikawa et al.

(10) Patent No.: US 11,139,107 B2
(45) Date of Patent: Oct. 5, 2021

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kouhei Yoshikawa, Mie (JP); Kazuhiro Inaba, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 445 days.

(21) Appl. No.: 16/318,757

(22) PCT Filed: Jul. 7, 2017

(86) PCT No.: PCT/JP2017/024973
§ 371 (c)(1),
(2) Date: Jan. 18, 2019

(87) PCT Pub. No.: WO2018/016353
PCT Pub. Date: Jan. 25, 2018

(65) Prior Publication Data

US 2019/0287714 A1 Sep. 19, 2019

(30) Foreign Application Priority Data

Jul. 22, 2016 (JP) ..... JP2016-144599

(51) Int. Cl.
*H01F 27/02* (2006.01)
*H01F 27/32* (2006.01)
(Continued)

(52) U.S. Cl.
CPC ..... *H01F 27/32* (2013.01); *H01F 3/14* (2013.01); *H01F 27/02* (2013.01); *H01F 27/255* (2013.01);
(Continued)

(58) Field of Classification Search
CPC ..... H01F 3/14; H01F 27/306; H01F 27/2823
(Continued)

(56) References Cited

U.S. PATENT DOCUMENTS 9,099,236 B2 * 8/2015 Nomura ..... H01F 41/02
2012/0229118 A1 9/2012 Kurita et al.
(Continued)

FOREIGN PATENT DOCUMENTS

JP S62-037918 A 2/1987
JP 2016-076597 A 5/2016

OTHER PUBLICATIONS

International Search Report, Application No. PCT/JP2017/024973, dated Oct. 10, 2017.

*Primary Examiner* — Ronald Hinson
(74) *Attorney, Agent, or Firm* — Honigman LLP

(57) ABSTRACT

A reactor includes a coil having a pair of wound portions that are arranged side-by-side; a magnetic core having inner core portions that are disposed inside the wound portions and outer core portions that are exposed from the wound portions; and gap portions each constituted by a portion of respective insulating members that are disposed between the coil and the magnetic core, the gap portions dividing the outer core portions in a direction in which the wound portions are arranged side-by-side.

6 Claims, 7 Drawing Sheets

(51) Int. Cl.

| | |
|---|---|
| ***H01F 27/255*** | (2006.01) |
| ***H01F 27/28*** | (2006.01) |
| ***H01F 41/12*** | (2006.01) |
| ***H01F 27/30*** | (2006.01) |
| ***H01F 3/14*** | (2006.01) |
| ***H01F 37/00*** | (2006.01) |

(52) U.S. Cl.
CPC ..... *H01F 27/2823* (2013.01); *H01F 27/306* (2013.01); *H01F 37/00* (2013.01); *H01F 41/12* (2013.01)

(58) Field of Classification Search
USPC ..... 336/90
See application file for complete search history.

(56) References Cited

U.S. PATENT DOCUMENTS

| | | | | |
|---|---|---|---|---|
| 2013/0038415 | A1* | 2/2013 | Ooishi | H01F 37/00 336/61 |
| 2013/0088317 | A1* | 4/2013 | Tawara | H01F 27/306 336/212 |
| 2015/0043262 | A1* | 2/2015 | Ito | H01F 27/263 363/131 |
| 2016/0189862 | A1* | 6/2016 | Miyauchi | H01F 41/005 29/606 |

* cited by examiner

10:2, 3
2:2A, 2B, 2R
6:60, 61
5:50, 51, 52

REACTOR

CROSS-REFERENCE TO RELATED APPLICATIONS

This application is the U.S. national stage of PCT/JP2017/024973 filed Jul. 7, 2017, which claims priority of Japanese Patent Application No. JP 2016-144599 filed Jul. 22, 2016.

TECHNICAL FIELD

The present disclosure relates to a reactor.

BACKGROUND

JP 2013-128084A discloses a reactor that includes a coil having a pair of wound portions arranged side-by-side and a magnetic core forming a closed magnetic circuit and is used as a component of a converter of a hybrid automobile, for example. The magnetic core can be divided into inner core portions that are disposed inside the wound portions and outer core portions that are disposed outside the wound portions. In the reactor disclosed in JP 2013-128084A, magnetic properties of the magnetic core are adjusted by forming the magnetic core from a plurality of divided cores and disposing gap plates between the divided cores.

With recent developments of electric vehicles such as hybrid automobiles, there is demand for improving the productivity of reactors. To address this issue, an object of the present disclosure is to provide a reactor having excellent productivity.

SUMMARY

A reactor of the present disclosure is a reactor includes a coil having a pair of wound portions that are arranged side-by-side. A magnetic core having inner core portions are disposed inside the wound portions and outer core portions that are exposed from the wound portions. Gap portions each constituted by a portion of respective insulating members are disposed between the coil and the magnetic core, the gap portions dividing the outer core portions in a direction in which the wound portions are arranged side-by-side.

Advantageous Effects of the Present Disclosure

The reactor according to the present disclosure has excellent productivity.

DETAILED DESCRIPTION OF PREFERRED EMBODIMENTS

Figure 1:
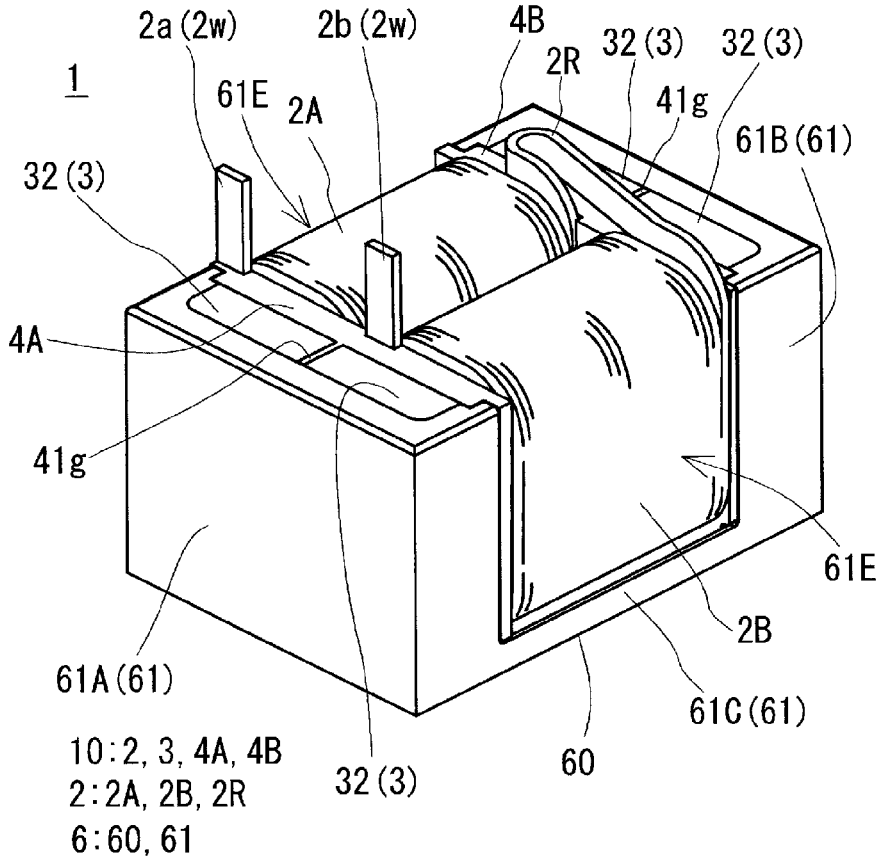
FIG. 1 is a perspective view of a reactor according to Embodiment 1.

First, aspects of the present disclosure will be listed and described.

A reactor according to an embodiment includes a coil having a pair of wound portions that are arranged side-by-side. A magnetic core having inner core portions that are disposed inside the wound portions and outer core portions that are exposed from the wound portions. Gap portions each constituted by a portion of respective insulating members that are disposed between the coil and the magnetic core, the gap portions dividing the outer core portions in a direction in which the wound portions are arranged side-by-side.

With the reactor according to the embodiment, since the gap portions are formed at positions of the outer core portions using a portion of the respective insulating members that are disposed between the coil and the magnetic core, the time taken to prepare a gap material separately and the time taken to dispose the gap material can be reduced. The productivity of the reactor according to the embodiment is correspondingly superior to that of conventional reactors.

In the reactor according to the embodiment, it is possible that the magnetic core is composed of a composite material containing a soft magnetic powder and a resin.

In the case where the entire magnetic core is composed of the composite material, after the coil is disposed in a mold or the case, the magnetic core can be produced simply by filling the composite material into the mold or the case. Therefore, the time taken to prepare divided cores and the time taken to combine the prepared divided cores can be reduced, and the productivity of the reactor can be improved.

Here, in a case where the magnetic core is produced by filling the composite material, it is difficult to provide gap portions inside the wound portions of the coil. The reason for this is that it is difficult to fix members constituting the gap portions at predetermined positions inside the wound portions, and the positions of the members are likely to be changed by the filling pressure of the composite material. In contrast, with the reactor according to the embodiment, the gap portions are disposed at positions of the outer core portions, and the problem of it being difficult to fix members constituting the gap portion due to the coil being an obstruction is thus eliminated.

In the reactor according to the embodiment, it is possible that the insulating members are end surface connecting members that are disposed between end surfaces of the wound portions and the outer core portions, and each of the gap portions is integrated with a surface of the respective end surface connecting members on the opposite side to a side on which the coil is disposed.

Since portions constituting the gap portions are integrated with the end surface connecting members, when the end surface connecting members are combined with the coil, the gap portions can be automatically disposed at positions of the outer core portions. This configuration is particularly effective in the case where the magnetic core is composed of a composite material. The reason for this is that, when the end surface connecting members are fixed to the coil, the positions of the gap portions relative to the coil are also fixed, and therefore, the gap portions are kept at predetermined positions even when the composite material is filled into a mold or the case that houses the coil during the production of the reactor.

In the reactor according to the embodiment, it is possible that: the insulating members are constituted by a coil molded portion with which the coil is coated. The coil molded portion includes turn coating portions that integrate turns of the wound portions; and end surface coating portions that are disposed between end surfaces of the wound portions and the outer core portions, and each of the gap portions is integrated with a surface of the respective end surface coating portions on the opposite side to a side on which the coil is disposed.

Since the turns of the coil are integrated by the turn coating portions of the coil molded portion, the coil is easy to handle. Also, insulation between the end surfaces of the wound portions and the outer core portions can be ensured by the end surface coating portions of the coil molded portion.

Since portions constituting the gap portions are integrated with the coil molded portion, the gap portions can always be kept at predetermined positions relative to the coil. This configuration is particularly effective in the case where the magnetic core is composed of a composite material. Since the positions of the gap portions relative to the coil are fixed, even when the composite material is filled into a mold or the case that houses the coil, the positions of the gap portions relative to the coil are not be changed by the filling pressure of the composite material.

Hereinafter, embodiments of a reactor of the present disclosure will be described based on the drawings. In the drawings, like reference numerals denote objects having like names. It should be understood that the present disclosure is not to be limited to configurations described in the embodiments, but rather is to be defined by the appended claims, and all changes that come within the meaning and range of equivalency of the claims are intended to be embraced therein.

Embodiment 1

In Embodiment 1, the configuration of a reactor 1 will be described based on FIGS. 1 to 3. The reactor 1 shown in FIG. 1 includes an assembly 10 in which a coil 2, a magnetic core 3, and end surface connecting members 4A and 4B are combined, as well as a case 6 in which the assembly 10 is housed. Hereinafter, the various components of the reactor 1 will be described in detail, and then, a method for producing the reactor 1 will be described.

Assembly

Coil

Figure 3:
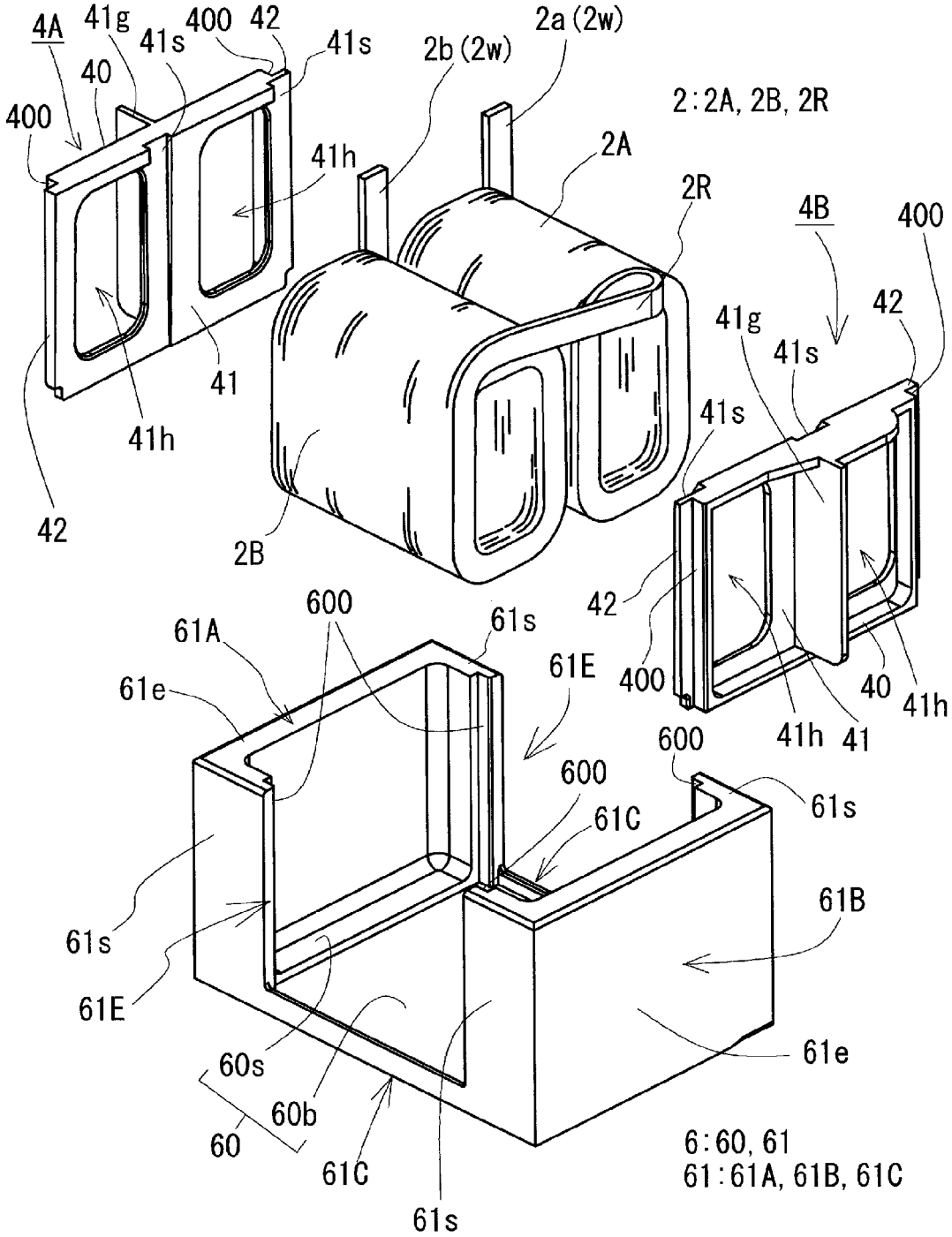
FIG. 3 is a partially exploded perspective view of the reactor according to Embodiment 1.

As shown in FIG. 3, the coil 2 of the present embodiment includes a pair of wound portions 2A and 2B and a connecting portion 2R that connects the two wound portions 2A and 2B to each other. The wound portions 2A and 2B are portions in which a wire 2*w* is helically wound, are formed into hollow tubular shapes having the same number of turns and the same winding direction, and are arranged side-by-side such that their axial directions are parallel to each other. In the present example, the coil 2 is made from a single wire 2*w*; however, a coil 2 may also be made by connecting wound portions 2A and 2B that are made from separate wires to each other.

Each of the wound portions 2A and 2B of the present embodiment are formed into a rectangular tube shape. The wound portions 2A and 2B having a rectangular tube shape refer to wound portions whose end surfaces have a quadrangular shape (including a square shape) with rounded corners. It goes without saying that the wound portions 2A and 2B may also be formed into a cylindrical tube shape. A cylindrical tube-shaped wound portion refers to a wound portion whose end surfaces have a closed curved shape (elliptical shape, perfect circle shape, racetrack shape, or the like).

The coil 2 including the wound portions 2A and 2B can be formed of a coated wire including a conductor, such as a rectangular wire or a round wire, made of a conductive material, such as copper, aluminum, magnesium, or an alloy thereof, and an insulating coating made of an insulating material and provided on the outer periphery of the conductor. In the present embodiment, the wound portions 2A and 2B are formed by winding a coated rectangular wire edgewise, the coated rectangular wire being constituted by a rectangular wire (wire 2*w*) made of copper, which serves as a conductor, and an insulating coating made of an enamel (typically, polyamideimide).

Both end portions 2*a* and 2*b* of the coil 2 are drawn out from the wound portions 2A and 2B and are connected to respective terminal members, which are not shown. The insulating coating made of an enamel or the like is stripped from the end portions 2*a* and 2*b*. An external device such as a power supply that supplies power to the coil 2 is connected via the terminal members.

Preferably, the wound portions 2A and 2B of the coil 2 are integrated by using a resin. In the case of the present example, the wound portions 2A and 2B of the coil 2 are each individually integrated by using an integrating resin. The integrating resin of the present example is formed by fusion-bonding a coating layer that is formed on the outer periphery (outer periphery of the insulating coating made of an enamel or the like) of the wire 2*w* and that is made of a thermally fusion-bondable resin, and is extremely thin. Therefore, even when the turns of the wound portions 2A and 2B are integrated by using the integrating resin, the shapes of the turns, or the boundaries between the turns, of the wound portions 2A and 2B can be externally recognized. Thermosetting resins such as epoxy resins, silicone resins, and unsaturated polyester, for example, can also be used as the material of the integrating resin.

Magnetic Core

Figure 2:
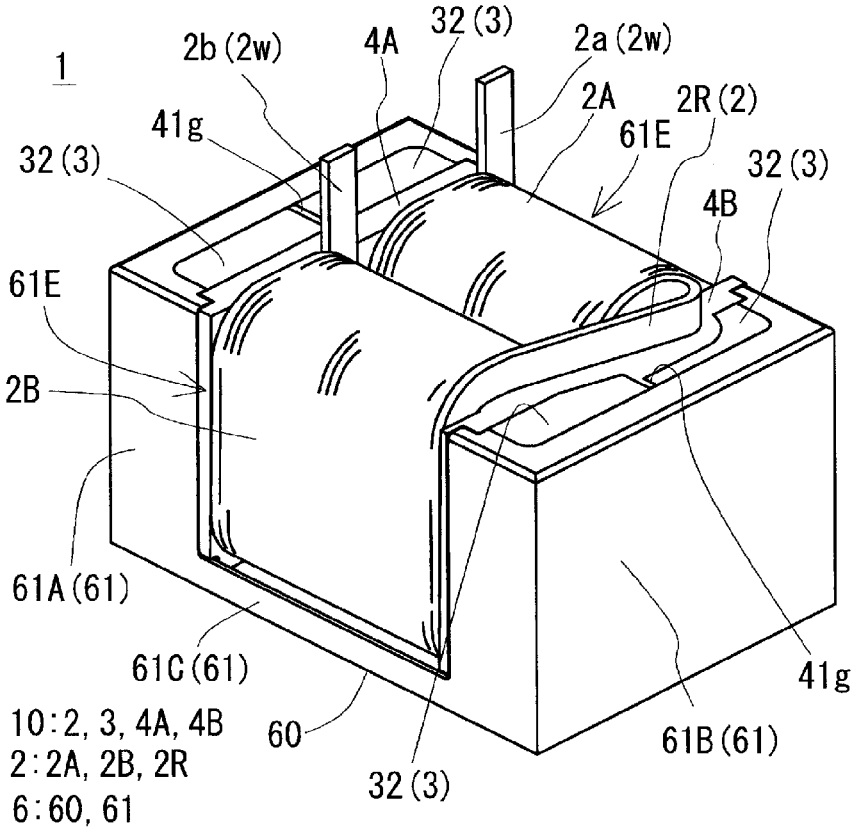
FIG. 2 is a perspective view of the reactor according to Embodiment 1 when viewed from the opposite side to that of FIG. 1.

As shown in FIGS. 1 and 2, the magnetic core 3 can be divided into outer core portions 32 that are disposed outside the wound portions 2A and 2B and inner core portions (not shown) that are disposed inside the wound portions 2A and 2B. In the present example, the outer core portions 32 and the inner core portions are integrally connected.

The outer core portions 32 are each divided by a gap portion 41*g* in a side-by-side arrangement direction in which the wound portions 2A and 2B are arranged side-by-side. The gap portions 41*g* are each constituted by a portion of the respective end surface connecting members 4A and 4B, which will be described later. Here, the gap portion 41*g* is not limited to a gap portion that physically completely divides the outer core portion 32 into two parts, and it is sufficient that the gap portion 41*g* is configured to be able to divide the magnetic circuit of the outer core portion 32. That is to say, the gap portion 41*g* need not be provided in a portion where it will not affect the magnetic circuit of the outer core portion 32. For example, even if a gap portion 41*g* has such a length that it does not reach the end surface of the outer core portion 32 in the axial direction of the wound portions 2A and 2B, it is sufficient that the gap portion 41*g* is disposed in a portion that constitutes the magnetic circuit.

The magnetic core 3 is composed of a composite material containing a soft magnetic powder and a resin. The soft magnetic powder is an aggregate of magnetic particles composed of an iron-group metal such as iron, an alloy thereof (a Fe—Si alloy, a Fe—Ni alloy, etc.), or the like. As will be described later in the description of the method for producing a reactor, the magnetic core 3 is formed by filling the inside of the case 6 with the composite material after the coil 2 is housed in the case 6. Therefore, the outer core portions 32 of the magnetic core 3 are joined to the inner peripheral surface of the case 6.

End Surface Connecting Members

As shown in FIG. 3, the end surface connecting members 4A and 4B are members that ensure insulation between end surfaces of the wound portions 2A and 2B and the outer core portions 32 (see FIGS. 1 and 2). The end surface connecting members 4A and 4B can be composed of, for example, thermoplastic resins such as polyphenylene sulfide (PPS) resins, polytetrafluoroethylene (PTFE) resins, liquid crystal polymers (LCPs), polyamide (PA) resins such as nylon 6 and nylon 66, polybutylene terephthalate (PBT) resins, and acrylonitrile-butadiene-styrene (ABS) resins. In addition, the end surface connecting members 4A and 4B can be formed of thermosetting resins such as unsaturated polyester resins, epoxy resins, urethane resins, and silicone resins. It is also possible to improve the heat dissipation properties of the end surface connecting members 4A and 4B by mixing a ceramic filler into the above-described resins. For example, a non-magnetic powder such as alumina or silica can be used as the ceramic filler.

The end surface connecting member 4A, which is located on the side (wire end portion side) where the end portions 2*a* and 2*b* of the wound portions 2A and 2B are disposed, and the end surface connecting member 4B, which is located on the side (connecting portion side) where the connecting portion 2R is disposed, have components with the same functions. In FIG. 3, components with the same functions are denoted by like reference numerals even though these components slightly differ from each other in terms of size, shape, and the like.

The end surface connecting members 4A and 4B are each constituted by a rectangular frame portion 40 and an end surface contact portion 41, which is a B-shaped plate-like member that comes into contact with the end surfaces of the wound portions 2A and 2B.

Two turn accommodating portions 41*s* (see, in particular, the end surface connecting member 4A) that accommodate axial end portions of the wound portions 2A and 2B are formed in a coil 2-side surface of each of the end surface contact portions 41. The turn accommodating portions 41*s* are recesses that conform to the shape of respective axial end surfaces of the wound portions 2A and 2B, and are formed in order to bring the entirety of end surfaces into surface contact with the end surface connecting members 4A and 4B. With the configuration in which the turn accommodating portions 41*s* bring the axial end surfaces of the wound portions 2A and 2B into surface contact with the end surface connecting members 4A and 4B, leakage of the resin from the contact portions can be suppressed.

The end surface contact portions 41 each include a pair of through holes 41*h*. The through holes 41*h* serve as inlets through which the composite material is filled into the inside of the wound portions 2A and 2B in the method for producing a reactor, which will be described later.

Each end surface contact portion 41 further includes the gap portion 41*g* that is provided between the pair of through holes 41*h*. The gap portion 41*g* is a plate-like member that protrudes away from the coil 2 in the axial direction of the wound portions 2A and 2B. As shown in FIGS. 1 and 2, the gap portion 41*g* divides the outer core portion 32 in the side-by-side arrangement direction of the wound portions 2A and 2B and forms a gap at a position of the outer core portion 32. Magnetic properties of the magnetic core 3 can be adjusted by adjusting the thickness of the gap portion 41*g*.

The end surface connecting members 4A and 4B each include a pair of protruding portions 42 that protrude outward in the side-by-side arrangement direction of the wound portions 2A and 2B from positions near the wound portions 2A and 2B of the external side surfaces 400, which oppose each other in the side-by-side arrangement direction of the wound portions 2A and 2B. The protruding portions 42 suppress contact between the case 6 and the wound portions 2A and 2B and also position the coil 2 in the case 6. Also, the protruding portions 42 have the function of making it less likely that the composite material will leak from the positions of the external side surfaces 400 when filling the composite material into the case 6 in the method for producing a reactor, which will be described later.

Case

As shown in FIG. 3, the case 6 is constituted by a bottom plate portion 60 and a side wall portion 61. The bottom plate portion 60 and the side wall portion 61 may be formed integrally, or may be formed by preparing a bottom plate portion 60 and a side wall portion 61 separately and then connecting these portions to each other. For example, a non-magnetic metal, such as aluminum or an alloy thereof, magnesium or an alloy thereof, or the like, or a resin or the like can be used as the material of the case 6. In the case where the bottom plate portion 60 and the side wall portion 61 are formed separately, the two portions 60 and 61 can also be made of different materials. For example, it is conceivable that the bottom plate portion 60 is made of a non-magnetic metal and the side wall is made of a resin, or vice versa.

Bottom Plate Portion

The bottom plate portion 60 of the present example includes a coil mount portion 60*b* on which the wound portions 2A and 2B are mounted and core contact portions 60*s* that are located higher than the coil mount portion 60*b* and come into contact with bottom surfaces of the respective outer core portions 32 (FIGS. 1 and 2). The coil mount portion 60*b* is integrated with connecting portions 61C of the side wall portion 61, which will be described later, and the core contact portions 60*s* are integrated with respective core opposing portions 61A and 61B of the side wall portion 61, which will be described later.

Side Wall Portion

The side wall portion 61 of the present example is constituted by the pair of core opposing portions 61A and 61B that oppose the outer peripheral surfaces of the respective outer core portions 32 (FIGS. 1 and 2) and the connecting portions 61C that connect the core opposing portions 61A and 61B to each other. The connecting portions 61C are provided in order to improve the rigidity of the side wall portion 61 by connecting the core opposing portions 61A and 61B to each other, and have such a height that the connecting portions 61C cover only the lower bent corner portions of the wound portions 2A and 2B. Therefore, as shown in FIGS. 1 and 2, an external side surface of the wound portion 2A in the side-by-side arrangement direction and an external side surface of the wound portion 2B in the side-by-side arrangement direction are exposed to the outside of the case 6. In other words, the side wall portion 61 of the case 6 of the present example can also be said to have a shape having cut-out portions 61E that are formed by cutting out portions corresponding to the external side surfaces of the respective wound portions 2A and 2B that oppose each other in the side-by-side arrangement direction and expose those external side surfaces to the outside of the case 6.

As shown in FIG. 3, the core opposing portions 61A and 61B are formed into a substantially C-shape when viewed from above. Specifically, the core opposing portions 61A and 61B are each formed by an end surface cover portion 61*e* that covers an end surface (end surface on the opposite side to the coil 2) of the corresponding outer core portion 32 (FIGS. 1 and 2) and a pair of side cover portions 61*s* that cover respective side surfaces of the outer core portion 32 being connected together into a C-shape. The outer surfaces of the side cover portions 61*s* are substantially flush with the external side surfaces of the respective wound portions 2A and 2B. The side cover portions 61*s* each include a thin portion 600 that is formed by reducing the thickness thereof near a corresponding coil 2-side edge portion, and as shown in FIGS. 1 and 2, the thin portions 600 cover the corresponding external side surfaces 400 of the end surface connecting members 4A and 4B. When the overlapping length between the thin portions 600 and the external side surfaces 400 is increased, leakage of the composite material from gaps between the end surface connecting members 4A and 4B and the core opposing portions 61A and 61B of the side wall portion 61 in the method for producing a reactor, which will be described later, can be suppressed.

Effects of Reactor

As a result of the gap portions 41*g* for adjusting the magnetic properties of the magnetic core 3 being formed in the end surface connecting members 4A and 4B as shown in the reactor 1 according to Embodiment 1, the time taken to prepare a gap material separately and the time taken to dispose the gap material can be reduced. Thus, the productivity of the reactor 1 can be improved.

Moreover, in the reactor 1 of the present example, the outer core portions 32 of the magnetic core 3 can be physically protected by the core opposing portions 61A and 61B of the side wall portion 61 of the case 6. Moreover, since the external side surfaces of the wound portions 2A and 2B are exposed from the side wall portion 61 of the case 6, heat is more likely to dissipate from the coil 2 to the outside of the case 6, and the heat dissipation properties of the reactor 1 can be further improved.

Uses

The reactor 1 of the present example can be used as a constituent member of a power conversion device such as a bidirectional DC-DC converter installed in electric vehicles such as hybrid automobiles, electric automobiles, and fuel-cell electric automobiles.

The reactor 1 can be used in a state in which it is immersed in a liquid coolant. Although there is no limitation on the liquid coolant, if the reactor 1 is used in a hybrid automobile, ATF (Automatic Transmission Fluid) or the like can be used as the liquid coolant. In addition, fluorine-based inert liquids such as Fluorinert (registered trademark), fluorocarbon-based coolants such as HCFC-123 and HFC-134a, alcohol-based coolants such as methanol and alcohol, and ketone-based coolants such as acetone can also be used as the liquid coolant.

Method for Producing Reactor

Next, an example of a method for producing a reactor that is used to produce the reactor 1 according to Embodiment 1 will be described. Roughly speaking, the method for producing a reactor includes the following steps. The method for producing a reactor will be described with reference mainly to FIG. 3.

Coil producing step
Integrating step
Case preparing step
Disposition step
Filling step
Curing step Coil Producing Step In this step, the wire 2*w* is prepared, and portions of the wire 2*w* are wound to produce the coil 2. A known winding machine can be used to wind the wire 2*w*. A coating layer that is composed of a thermally fusion-bondable resin and that constitutes the integrating resin, which integrates the turns of the wound portions 2A and 2B, can be formed on the outer periphery of the wire 2*w*. The thickness of the coating layer can be selected as appropriate. If the integrating resin is not provided, a wire 2*w* without a coating layer can be used, and the next integrating step is not required.

Integrating Step

In this step, the wound portions 2A and 2B of the coil 2 that has been produced in the coil producing step are integrated using the integrating resin. In the case where a coating layer composed of a thermally fusion-bondable resin is formed on the outer periphery of the wire 2*w*, the integrating resin can be formed by heat-treating the coil 2. On the other hand, in the case where no coating layer is formed on the outer periphery of the wire 2*w*, the integrating resin can be formed by applying a resin to the outer periphery or the inner periphery of the wound portions 2A and 2B of the coil 2 and curing the resin.

Case Preparing Step

In this step, as shown in FIG. 3, the case 6 including the side wall portion 61 having the cut-out portions 61E that expose the external side surface of one wound portion 2A in the side-by-side arrangement direction and the external side surface of the other wound portion 2B in the side-by-side direction is prepared as the case 6 for housing the coil 2. Note that the case preparing step can also be performed prior to the coil producing step or the integrating step.

Disposition Step

In this step, the coil 2 is disposed inside the case 6. In the present example, a first assembly in which the end surface connecting members 4A and 4B are attached to the coil 2 is inserted into the case 6 from above the case 6. The external side surfaces 400 of the end surface connecting members 4A and 4B are covered by the thin portions 600 of the core opposing portions 61A and 61B (see both of FIGS. 1 and 2). A space is formed between the inner peripheral surface of each core opposing portion 61A (61B) and the corresponding end surface connecting member 4A (4B). Also, the external side surface of the wound portion 2A is exposed from one of the cut-out portions 61E, and the external side surface of the wound portion 2B is exposed from the other cut-out portion 61E.

Filling Step

In the filling step, the composite material is filled into the space that is formed between the inner peripheral surface of each core opposing portion 61A (61B) and the corresponding end surface connecting member 4A (4B) from above that space. The composite material that has been filled into the case 6 accumulates in the space between each core opposing portion 61A (61B) and the corresponding end surface connecting member 4A (4B) and also flows into the inside of the wound portions 2A and 2B via the through holes 41*h* of the end surface connecting members 4A and 4B. Since the thin portions 600 of the core opposing portion 61A (61B) cover the respective external side surfaces 400 of the end surface connecting member 4A (4B), and the protruding portions 42 cover the respective end surfaces of the core opposing portion 61A (61B), leakage of the composite material to the outside of the case 6 from the positions of the external side surfaces 400 of the end surface connecting member 4A (4B) is suppressed.

Curing Step

In the curing step, the composite material is cured through heat treatment or the like. The portions of the cured composite material that are present inside the wound portions 2A and 2B constitute the inner core portions, and the portions of the cured composite material that are present outside the wound portions 2A and 2B constitute the outer core portions 32.

Embodiment 2

Figure 4:
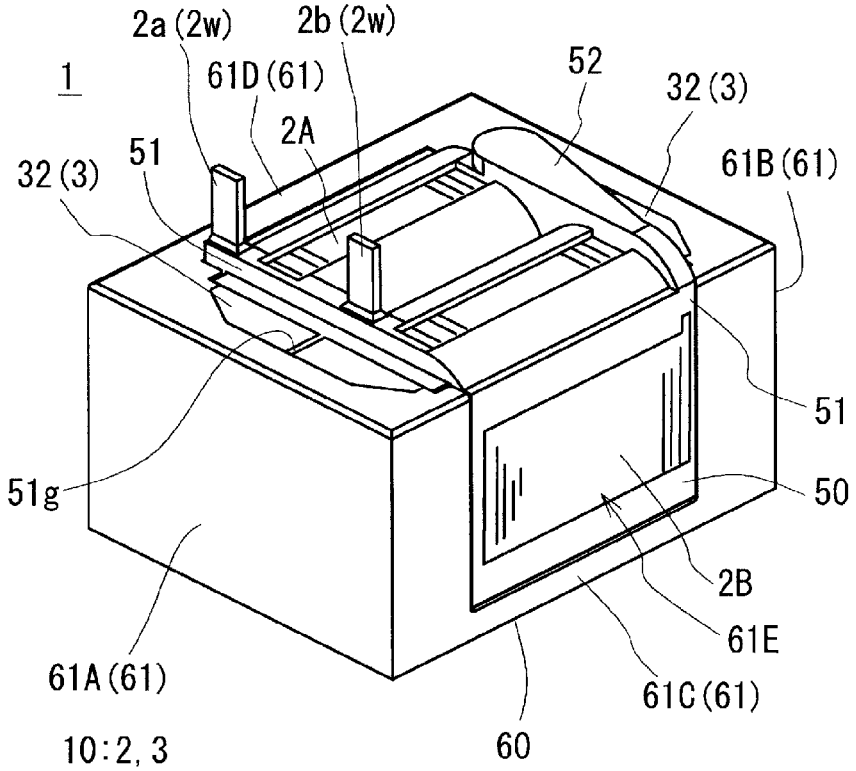
FIG. 4 is a perspective view of a reactor according to Embodiment 2.
Figure 5:
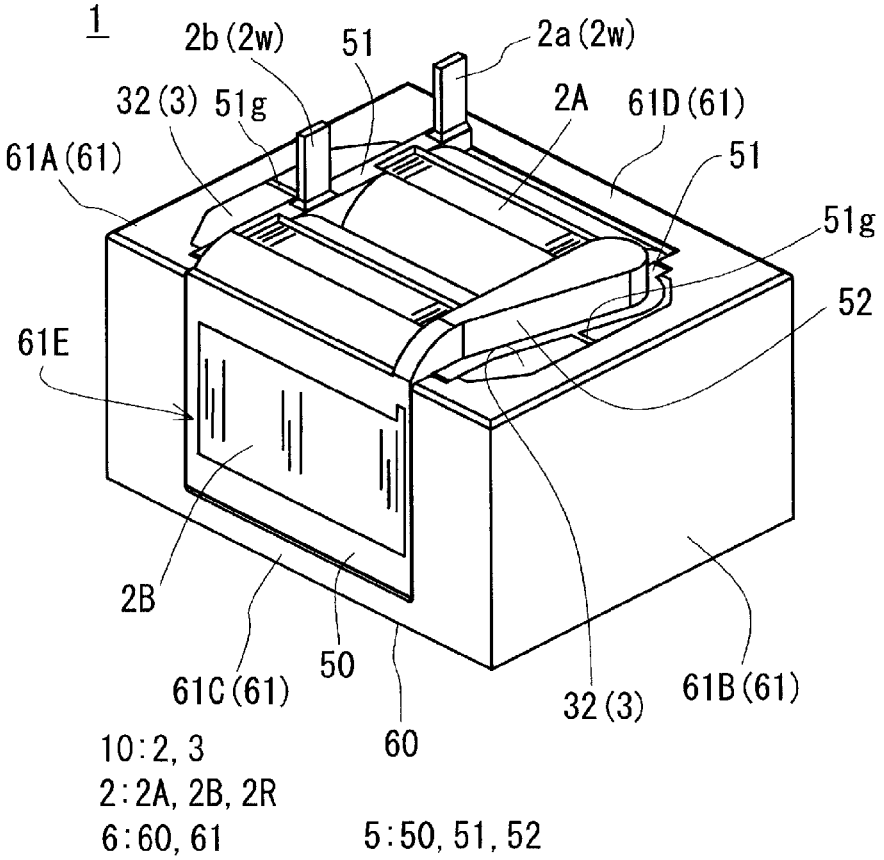
FIG. 5 is a perspective view of the reactor according to Embodiment 2 when viewed from the opposite side to that of FIG. 4.

In Embodiment 2, a configuration in which a coil 2 includes a coil molded portion 5 will be described based on FIGS. 4 to 6. Components having the same functions as those of Embodiment 1 are denoted by like reference numerals as those of Embodiment 1, and their description is omitted.

Case

The case 6 of Embodiment 2 differs from the case 6 of Embodiment 1 in terms of the configuration of the side wall portion 61. The side wall portion 61 of the case 6 of the present example includes a coil opposing portion 61D, in addition to the core opposing portions 61A and 61B and the connecting portion 61C on the wound portion 2B side. The coil opposing portion 61D is a member that opposes the external side surface of the wound portion 2A. That is to say, the side wall portion 61 of the case 6 of the present example is configured so as to enclose three surfaces of the outer peripheral surface of the assembly 10, excluding the external side surface of the wound portion 2B. The external side surface of the wound portion 2B is exposed to the outside of the case 6 at the position of the cut-out portion 61E. It goes without saying that the coil opposing portion 61D may also be provided on the wound portion 2B side so that the external side surface of the wound portion 2A is exposed to the outside of the case 6.

Coil

The coil 2 of the present example includes the coil molded portion 5. The coil molded portion 5 is composed of an insulating resin, and for example, the same materials as those of the end surface connecting members of Embodiment 1 can be used. As is the case with the end surface connecting members, the coil molded portion 5 may also contain a filler.

The coil molded portion 5 includes turn coating portions 50 that integrate the turns of the individual wound portions 2A and 2B and end surface coating portions 51 that are disposed between the end surfaces of the wound portions 2A and 2B and the outer core portions 32. Furthermore, the coil molded portion 5 includes a connecting-portion coating portion 52 that covers the connecting portion (not shown) between the wound portions 2A and 2B.

The wound portions 2A and 2B, which have a rectangular tube shape, of the coil 2 are each divided into four-corner portions that are formed by the wire 2*w* being bent and flat portions where the wire 2*w* is not bent. The turn coating portions 50 of the present example integrate the turns of the corresponding wound portions 2A and 2B by covering the four-corner portions of the wound portions 2A and 2B. The turn coating portions 50 do not cover the flat portions of the wound portions 2A and 2B, and therefore, heat dissipation from external side surfaces of the wound portions 2A and 2B is not inhibited by the turn coating portions 50.

Figure 6:
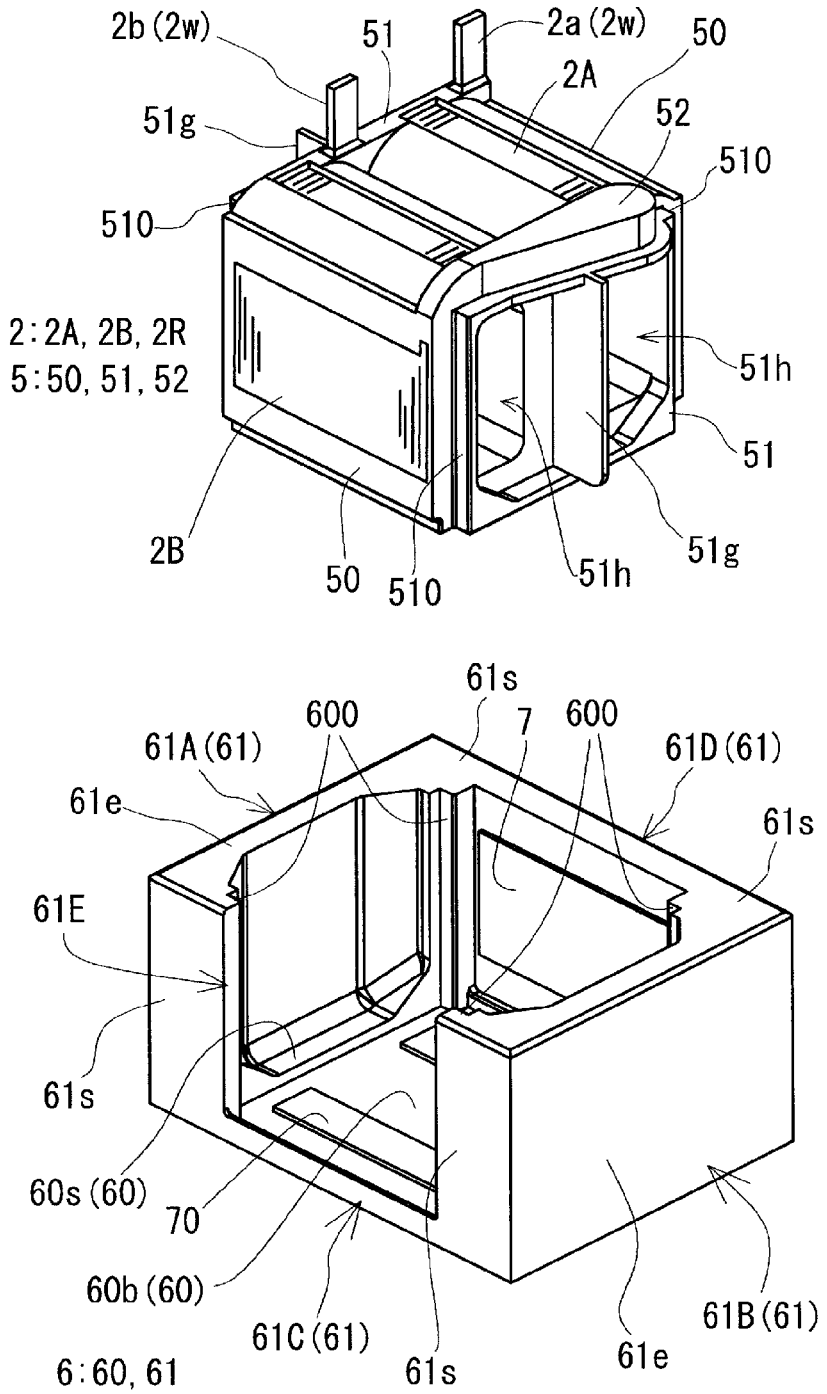
FIG. 6 is a partially exploded perspective view of the reactor according to Embodiment 2.

As shown in FIG. 6, the end surface coating portions 51 are provided so as to connect the turn coating portions 50 of the wound portion 2A and the turn coating portions 50 of the wound portion 2B. In each of the end surface coating portions 51, a pair of through holes 51*h* that are in communication with the inside of the wound portions 2A and 2B, respectively, are formed. The through holes 51*h* have the same function as the through holes 41*h* of the end surface connecting members 4A and 4B of Embodiment 1, that is, the function of guiding the composite material into the inside of the wound portions 2A and 2B during the production of the reactor.

The end surface coating portions 51 are each formed into a frame-like shape that protrudes away from the coil 2 in the axial direction of the wound portions 2A and 2B. External side surfaces (surfaces that oppose each other in the side-by-side arrangement direction of the wound portions 2A and 2B) 510 of the frame-shaped end surface coating portions 51 abut against the thin portions 600 of the core opposing portions 61A and 61B of the case 6. The external side surfaces 510 have the same functions as the external side surfaces 400 of the end surface connecting members 4A and 4B of Embodiment 1, that is, the functions of positioning the coil 2 in the case 6 and suppressing leakage of the composite material during the production of the reactor 1.

Each end surface coating portion 51 further includes a gap portion 51*g* that is provided between the pair of through holes 51*h*. The gap portion 51*g* is a plate-like member that protrudes away from the coil 2 in the axial direction of the wound portions 2A and 2B. As shown in FIGS. 4 and 5, the gap portion 51*g* divides the outer core portion 32 in the side-by-side arrangement direction of the wound portions 2A and 2B and forms a gap at a position of the outer core portion 32. Magnetic properties of the magnetic core 3 can be adjusted by adjusting the thickness of the gap portion 51*g*. Here, as is the case with the gap portions 41*g* of Embodiment 1, the gap portion 51*g* may have such a length that it does not reach the end surface of the outer core portion 32 in the axial direction of the wound portions 2A and 2B.

Effects of Reactor

As a result of the gap portions 51*g* for adjusting the magnetic properties of the magnetic core 3 being formed in the coil molded portion 5 of the coil 2 as shown in the reactor 1 according to Embodiment 2, the time taken to prepare a gap material separately and the time taken to dispose the gap material can be reduced. Thus, the productivity of the reactor 1 can be improved.

Moreover, the configuration of Embodiment 2 can increase the flexibility of installation of the reactor 1 more than the configuration in which both side surfaces of the coil 2 are exposed, while improving the heat dissipation properties of the reactor 1. The reason for this is that, with the configuration in which the side wall portion 61 of the case 6 includes the coil opposing portion 61D, not only the bottom plate portion 60 and the core opposing portions 61A and 61B but also the coil opposing portion 61D can be used as an attachment portion that can be attached to an object in which the reactor 1 is installed.

Method for Producing Reactor

To produce the reactor 1 according to Embodiment 2, as shown in FIG. 6, the coil 2 with the coil molded portion 5 and the case 6 are prepared. Then, the coil 2 is inserted into the inside of the case 6 (disposition step). At this time, it is advantageous to dispose a heat dissipation material 7 on the inner peripheral surface of the coil opposing portion 61D and also dispose a heat dissipation material 70 on the coil mount portion 60*b*. The dissipation of heat from the coil 2 to the case 6 can be promoted by providing the heat dissipation materials 7 and 70. For example, heat dissipation grease, a foamed heat dissipation sheet, or the like can be used as the heat dissipation materials 7 and 70.

As a result of inserting the coil 2 into the case 6, a space is formed between the inner peripheral surface of each core opposing portion 61A (61B) and the corresponding end surface coating portion 51. The composite material is filled into this space from above the space (filling step). The composite material that has been filled into the case 6 from this space accumulates in the space between each core opposing portion 61A (61B) and the corresponding end surface coating portion 51, thereby forming each outer core portion 32 (FIGS. 4 and 5), and flows into the inside of the wound portions 2A and 2B via the through holes 51*h*, thereby forming the inner core portions. Here, since the thin portions 600 of each core opposing portion 61A (61B) cover the external side surfaces 510 of the end surface coating portion 51, leakage of the composite material to the outside of the case 6 from the positions of the external side surfaces 510 of the end surface coating portion 51 is suppressed.

Embodiment 3

As described in Embodiments 1 and 2, the magnetic core 3 of the present disclosure is configured by filling the composite material into the case 6. That is to say, the outer core portions 32 of the magnetic core 3 are joined to the inner peripheral surface of the side wall portion 61 (inner peripheral surfaces of the core opposing portions 61A and 61B), and detachment of the assembly 10 from the case 6 is thus suppressed. In order to more effectively suppress detachment of the assembly 10 from the case 6, it is preferable to provide the case 6 with a detachment preventing configuration. A specific example of the detachment preventing configuration will be described based on FIG. 7.

Figure 7:
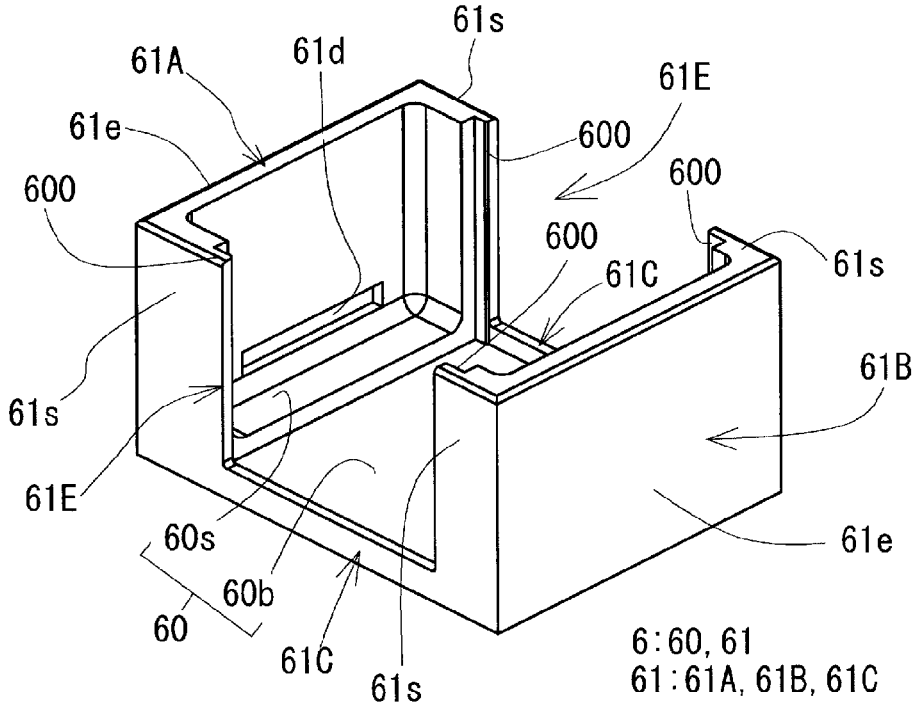
FIG. 7 is a schematic perspective view of a case included in a reactor according to Embodiment 3.

FIG. 7 is a schematic perspective view of a case 6 for use in Embodiment 3. The case 6 in FIG. 7 is almost the same as the case 6 in FIG. 3 of Embodiment 1, but differs from the case 6 of Embodiment 1 in that the inner peripheral surface of the core opposing portion 61A has a detachment preventing recess 61*d*. Note that, although located at a position that cannot be seen in FIG. 7, the inner peripheral surface of the core opposing portion 61B also has a detachment preventing recess 61*d* that is similar to that of the core opposing portion 61A.

The detachment preventing recess 61*d* is formed by a portion near the bottom plate portion 60, of the inner peripheral surface of the end surface cover portion 61*e* of the core opposing portion 61A being recessed in a direction away from the outer core portion 32 (see FIG. 1). If the composite material is filled into the inside of the case 6 that has this detachment preventing recess 61*d*, a portion of the outer core portion 32 enters the detachment preventing recess 61*d*, and the outer core portion 32 engages with the detachment preventing recess 61*d*. This engagement can suppress detachment of the assembly 10 from the case 6.

Unlike FIG. 7, the detachment preventing recess 61*d* can also be provided at a position of a side cover portion 61*s*. Moreover, the detachment preventing recess 61*d* can also be applied to the case 6 of Embodiment 2.

The invention claimed is:

1. A reactor comprising:

a coil having a pair of wound portions that are arranged side-by-side;

a magnetic core having inner core portions that are disposed inside the wound portions and outer core portions that are exposed from the wound portions; and gap portions each constituted by a portion of respective insulating members that are disposed between the coil and the magnetic core, the gap portions dividing the outer core portions in a direction in which the wound portions are arranged side-by-side.

2. The reactor according to claim 1, wherein the magnetic core is composed of a composite material containing a soft magnetic powder and a resin.

3. The reactor according to claim 1, wherein the insulating members are end surface connecting members that are disposed between end surfaces of the wound portions and the outer core portions, and each of the gap portions is integrated with a surface of the respective end surface connecting members on the opposite side to a side on which the coil is disposed.

4. The reactor according to claim 1, wherein the insulating members are constituted by a coil molded portion with which the coil is coated, the coil molded portion including:

turn coating portions that integrate turns of the wound portions; and end surface coating portions that are disposed between end surfaces of the wound portions and the outer core portions, and each of the gap portions is integrated with a surface of the respective end surface coating portions on the opposite side to a side on which the coil is disposed.

5. The reactor according to claim 2, wherein the insulating members are end surface connecting members that are disposed between end surfaces of the wound portions and the outer core portions, and each of the gap portions is integrated with a surface of the respective end surface connecting members on the opposite side to a side on which the coil is disposed.

6. The reactor according to claim 2, wherein the insulating members are constituted by a coil molded portion with which the coil is coated, the coil molded portion including:

turn coating portions that integrate turns of the wound portions; and end surface coating portions that are disposed between end surfaces of the wound portions and the outer core portions, and each of the gap portions is integrated with a surface of the respective end surface coating portions on the opposite side to a side on which the coil is disposed.

* * * * *